US007069639B2

(12) United States Patent
Choi et al.

(10) Patent No.: US 7,069,639 B2
(45) **Date of Patent: *Jul. 4, 2006**

(54) METHOD OF MAKING CHIP TYPE POWER INDUCTOR

(75) Inventors: Myoung-Hui Choi, Seoul (KR); Soon-Gyu Hong, Gyeonggi-Do (KR); Sang-Eun Jang, Gyeonggi-Do (KR)

(73) Assignee: Ceratech Corporation (KR)

( * ) Notice: Subject to any disclaimer, the term of this patent is extended or adjusted under 35 U.S.C. 154(b) by 123 days.

This patent is subject to a terminal disclaimer.

(21) Appl. No.: 10/723,753

(22) Filed: Nov. 25, 2003

(65) Prior Publication Data

US 2004/0108934 A1 Jun. 10, 2004

(30) Foreign Application Priority Data

Nov. 30, 2002 (KR) ..... 10-2002-0075680

(51) Int. Cl.
*H01F 7/06* (2006.01)

(52) U.S. Cl. ..... 29/602.1; 29/604; 336/200; 336/223; 336/232

(58) Field of Classification Search ..... 23/602.1, 23/604–608, 609; 336/200, 223, 232
See application file for complete search history.

(56) References Cited

U.S. PATENT DOCUMENTS

| | | | | |
|---|---|---|---|---|
| 3,765,082 | A * | 10/1973 | Zyetz | 29/602.1 |
| 5,479,695 | A * | 1/1996 | Grader et al. | 29/602.1 |
| 6,249,205 | B1 * | 6/2001 | Meadors et al. | 336/200 |
| 6,293,001 | B1 * | 9/2001 | Uriu et al. | 29/608 |
| 6,675,462 | B1 * | 1/2004 | Takahashi | 29/602.1 |
| 6,917,274 | B1 * | 7/2005 | Hong et al. | 336/200 |
| 6,918,173 | B1 * | 7/2005 | Ahn | 29/602.1 |

* cited by examiner

*Primary Examiner*—Minh Trinh
(74) *Attorney, Agent, or Firm*—Ostrolenk, Faber, Gerb & Soffen, LLP

(57) ABSTRACT

A method of fabricating a chip type power inductor includes the steps of: preparing green sheets: forming cutting lines on a magnetic layer green sheet and a non-magnetic layer green sheet; forming via holes on the non-magnetic layer green sheet where the cutting lines are formed, and forming an electrode pattern at an upper surface of the non-magnetic layer green sheet; stacking a plurality of layers by constituting the magnetic layer and the non-magnetic layer where via holes and electrode patterns are formed as one unit in a state that a non-magnetic layer where cutting lines and electrode patterns are not formed is inserted; stacking a cover layer composed of a magnetic layer at upper and lower surfaces of the stacked layers; firing the stacked body; and forming external electrodes at an outer surface of the fired stack body.

3 Claims, 8 Drawing Sheets

METHOD OF MAKING CHIP TYPE POWER INDUCTOR

BACKGROUND OF THE INVENTION

1. Field of the Invention

The present invention relates to a chip type power inductor and a fabrication method thereof, and more particularly, to a small chip type power inductor in which a current limitation due to a magnetic saturation is less and a fabrication method thereof.

2. Description of the Conventional Art

Generally, a chip type inductor is divided into an inductor for a signal line and an inductor for a power line. Whereas the inductor for a signal line has a rated current corresponding to several mA~several tens of mA, the inductor for a power line has a comparatively great rated current corresponding to several hundreds of mA~several A.

Recently, as an electronic instrument becomes small, electronic components used therein also become small and light. However, a comparative capacity ratio of a power circuit used in the electronic instrument is increased for an entire volume of the electronic instrument. This is because each kind of LSI including a CPU used in each kind of electronic circuit becomes fast and high-integrated but magnetic components such as an inductor and a transformer which are essential circuit factors of a power circuit have a difficulty in becoming small.

When the magnetic components such as an inductor and a transformer become small and thus a capacity of a magnetic substance is decreased, a magnetic core easily becomes magnetically saturated. Accordingly, a current amount capable of being used as a power device is decreased.

As a magnetic substance used in fabricating an inductor, a Ferrite based magnetic material or a metal magnetic substance are used. The ferrite based magnetic material is mainly used in a multi-layer chip type inductor having an advantage in a mass production and a miniaturization. The ferrite has high magnetic permeability and electric resistance, but has a low saturation magnetic flux density. Therefore, if the ferrite is used as it is, an inductance is greatly lowered by a magnetic saturation and a DC bias characteristic is deteriorated. Accordingly, as the conventional power inductor, a winding type power inductor that conducting wire is wound on a metal magnetic substance having a high saturation magnetic flux density in spite of a high loss and a low electric resistance was mainly used. Also, in case of the multi-layer power inductor, a usable current range was so less.

Recently, as portable devices are rapidly increased, a demand for low consumption power components for minimizing a battery consumption is being increased. According to this, a D-class amplifier is much being used in a car-stereo, a PDA, a notebook PC, and etc. Whereas A and B class amplifiers levels amplify a signal by an amplification function (an analogue process) of a vacuum tube, a transistor, and etc. the D-class amplifier amplifies a signal by switching operation (digital processing). The D-class amplifier has a high efficiency and thus less generates heat from the inside thereof, so that large power package and heat sink can be omitted and thereby the amplifier can become small. An output of the D-class amplifier is supplied to a speaker through a low pass filter. An inductor which constitutes the low pass filter has to have low loss and high DC bias characteristics. As a power inductor for the D-class amplifier, a winding type product is mainly being used nowadays.

However, as aforementioned, since the winding type product has a limitation in a small size, a small multi-layer power inductor which can be easily mounted in a portable device has been much required.

SUMMARY OF THE INVENTION

Therefore, an object of the present invention is to provide a small multi-layer power inductor in which a current limitation due to a magnetic saturation is less.

Another object of the present invention is to provide a fabrication method of a chip type power inductor having an advantage in mass production and capable of reducing a fabrication cost.

In the present invention, a micro gap is introduced in a magnetic substance which forms a magnetic core in the chip type power inductor in order to prevent a magnetic saturation at a low bias current.

To achieve these and other advantages and in accordance with the purpose of the present invention, as embodied and broadly described herein, there is provided a chip type power inductor comprising: a magnetic substance which forms a magnetic core stacked with a plurality of layers; non-magnetic layers inserted to inside of the magnetic substance which forms a magnetic core; coil patterns formed on either upper surfaces or lower surfaces of the plurality of layers of the magnetic substance which forms a magnetic core; and via holes formed at the plurality of layers constituting the magnetic substance which forms a magnetic core in order to electrically connect the coil patterns.

Each layer constituting the magnetic substance which forms a magnetic core can constitute one layer by a non-magnetic electrode layer having an opening at a center and electrode patterns on at least one surface between upper and lower surfaces thereof and a magnetic layer positioned at the center opening and lateral surfaces of the non-magnetic electrode layer.

As a non-magnetic substance, $B_2O_3$—$SiO_2$ based glass, $Al_2O_3$—$SiO_2$ based glass, or other ceramic material are used, and as a magnetic substance, Ni-based ferrite, Ni—Zn based ferrite, Ni—Zn—Cu based ferrite, and etc. can be used.

In the present invention, a non-magnetic micro gap is formed at a magnetic path formed by ferrite, thereby preventing a magnetic saturation from occurring at a low current. Accordingly, a usable current range of a product can be extended.

To achieve these and other advantages and in accordance with the purpose of the present invention, as embodied and broadly described herein, there is also provided a fabrication method of a chip type power inductor comprising: preparing green sheets that a magnetic layer and a non-magnetic layer are respectively formed on a carrier film; forming cutting lines on the magnetic layer green sheet and the non-magnetic layer green sheet; forming via holes on the non-magnetic layer green sheet where the cutting lines are formed, and forming an electrode pattern at an upper surface of the non-magnetic layer green sheet; picking up unnecessary parts from the magnetic layer green sheet and the non-magnetic layer green sheet and thus corresponding remaining parts of the magnetic substance to the picked up parts of the non-magnetic substance or corresponding the picked up parts of the magnetic substance to remaining parts of the non-magnetic substance; stacking a plurality of layers by constituting the magnetic layer and the non-magnetic layer where the via holes and the electrode patterns are formed as one unit layer in a state that the non-magnetic layer where the cutting lines and the electrode patterns are not formed is inserted; stacking cover layers constituted of a magnetic layer at upper and lower surfaces of the stacked layers; firing the stacked body; and forming an external electrode at an outer surface of the fired body.

In the present invention, a magnetic saturation is restrained by a non-magnetic micro gap formed at an inner part of the power inductor, so that a DC bias characteristic corresponding to several hundreds of mA~1 A which could not be realized by the conventional multi-layer chip power inductor can be obtained and a small and light chip power inductor capable of being used in a small portable device can be realized according to a structure and a fabrication method of the chip type power inductor.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
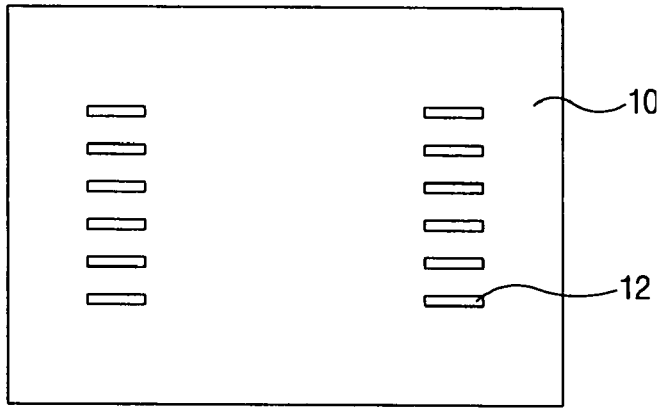
FIG. 1 BACKGROUND ART
FIG. 1 is a sectional mimetic diagram showing a structure of a chip type power inductor in accordance with the conventional art.

FIG. 1 shows one embodiment of a chip type power inductor. As shown, electrode patterns 12 are formed in a magnetic substance which forms a magnetic core 10 integrally formed as a plurality of magnetic layers are stacked. In the chip type power inductor of said structure, a magnetic saturation in a low current can not be prevented.

Figure 2A:
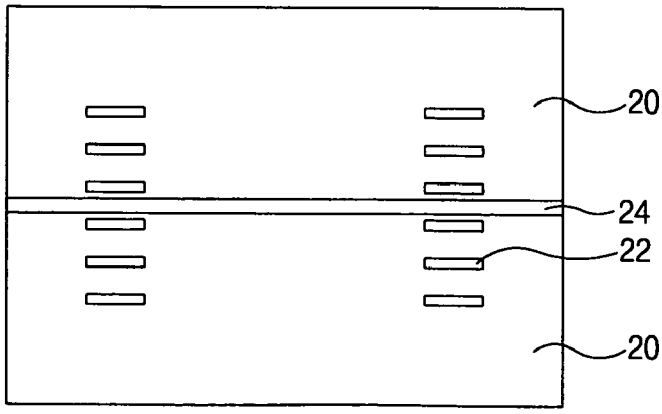
FIG. 2A is a sectional mimetic diagram showing a structure of a chip type power inductor according to the present invention.

FIG. 2A is a basic structure of a power inductor according to the present invention, in which a non-magnetic layer 24 is formed in the magnetic substance which forms a magnetic core 20. The non-magnetic layer increases a magnetic resistance of the magnetic substance which forms a magnetic core and thus prevents a magnetic saturation from occurring in a low current. The magnetic substance which forms a magnetic core is constituted with several unit layers, and electrode patterns 22 are formed on each layer. The non-magnetic layer 24 is preferably inserted into one position between several layers constituting the magnetic substance which forms a magnetic core, and a thickness thereof is determined by considering an electric characteristic of the power inductor. Electrode patterns need not be formed on the non-magnetic layer, and via holes are preferably formed in order to electrically connect electrode patterns formed on the layers positioned at upper and lower surfaces of the non-magnetic layer one another.

Figure 2B:
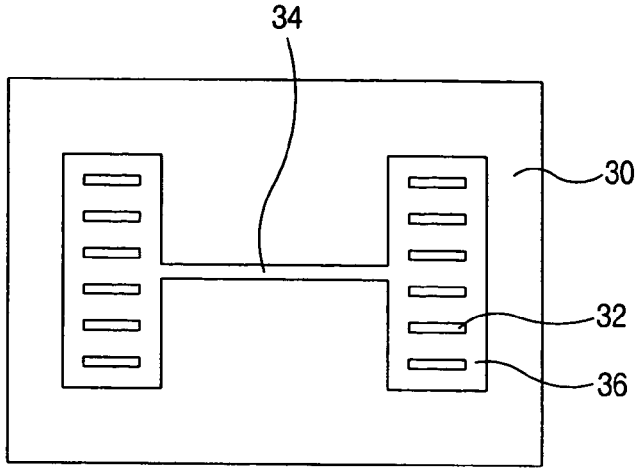
FIG. 2B is a sectional mimetic diagram showing another structure of a chip type power inductor according to the present invention.
Figure 3:
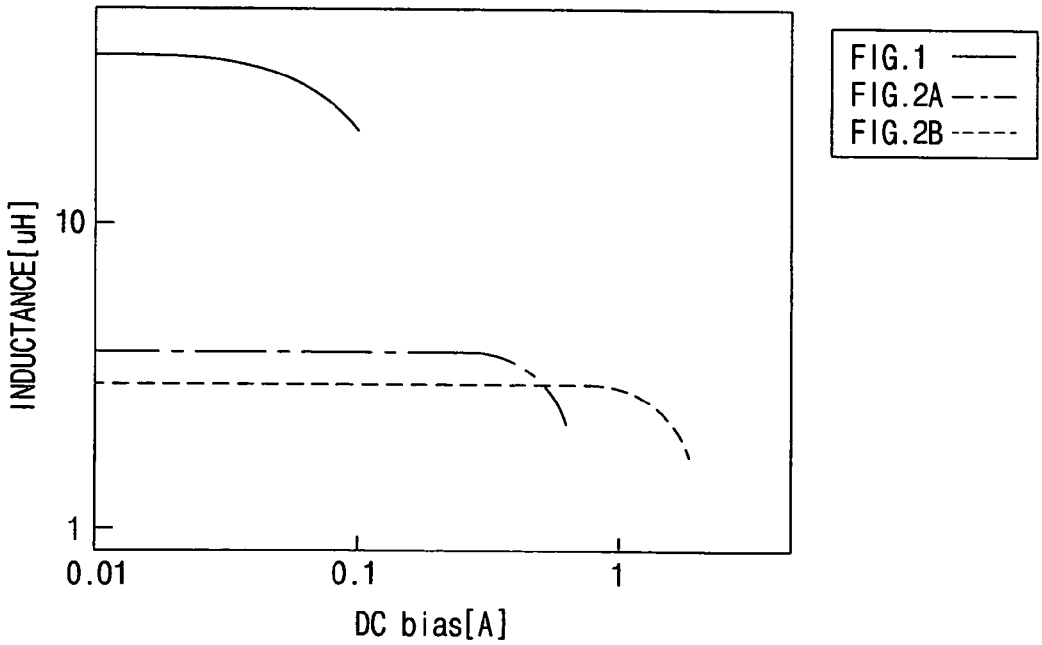
FIG. 3 is a graph showing electric characteristics according to a structure of a chip type power inductor.

FIG. 2B is a sectional mimetic diagram showing a variation example of the power inductor of the present invention, in which the magnetic substance which forms a magnetic core where a plurality of layers are stacked is divided into a magnetic substance region 30 and a non-magnetic substance region 36. The magnetic substance region is divided into a magnetic substance formed at a center surrounded by the non-magnetic substance regions and a magnetic substance formed at a periphery of the non-magnetic substance regions. A non-magnetic layer 34 is inserted into an inside of the magnetic substance which forms a magnetic core, and thereby shields a magnetic path of the magnetic substance which forms a magnetic core thus to increase a magnetic resistance likewise the embodiment shown in FIG. 2A. Although each region seems to be independent to each other, each region constitutes one layer at the time of a substantial fabrication and the layers are stacked to be integrally formed. Details of the fabrication process will be explained. In the power inductor of said structure, electrode patterns 32 are formed on at least one surface between upper and lower surfaces of each layer constituting the non-magnetic substance region inside of the magnetic substance which forms a magnetic core. If the electrode patterns are formed on the non-magnetic layers having higher electric resistance and lower permeability and dielectric constant than magnetic material, an insulation degradation resulting from that a thickness of each layer becomes small can be prevented and a parasitic capacitance generation is restrained, thereby improving frequency characteristics.

A following table 1 shows electric characteristics of the power inductor having each structure shown in FIGS. 1, 2A, and 2B, and FIG. 3 shows the result as a graph.

TABLE 1

Comparison of electric characteristics of a designed power inductor by each structure

| | Inductance (μH) | Magnetic saturation current (mA) |
|---|---|---|
| A case that the non-magnetic layer is not inserted (FIG. 1) | 30 | 50 |
| A case that the non-magnetic layer is inserted and the magnetic substance which forms a magnetic core is formed of a magnetic substance (FIG. 2A) | 4 | 260 |
| A case that the non-magnetic layer is inserted and the magnetic substance which forms a magnetic core is formed of a magnetic substance and a non-magnetic substance (FIG. 2A) | 3 | 1250 |

In said table, the magnetic saturation current is a current value at the time when a DC bias is applied and thereby an inductance value is reduced by 10%. In the case that the non-magnetic layer is not inserted, the inductance is high compared to other structures but the magnetic saturation is generated at 50 mA. On the contrary, in case of a power inductor to which the non-magnetic substance is inserted, the magnetic saturation current value becomes great. Especially, in case that the non-magnetic layer is inserted and the magnetic substance which forms a magnetic core is formed of a magnetic substance and a non-magnetic substance, the magnetic saturation current value exceeds 1A which is a value greater than that of the case that the non-magnetic layer is not inserted by more than 20 times.

In the power inductor according to the present invention, not only electric characteristics are increased but also mass production is possible and a fabrication cost is reduced. Referring to FIG. 2A, electrode patterns are formed on a plurality of magnetic sheets, the magnetic sheets are stacked, and a non-magnetic layer where the electrode patterns are not formed is inserted to the inside of the stacked sheets. Hereinafter, detail processes will be explained on the basis of a structure of the power inductor shown in FIG. 2B, and the processes can be applied to a structure shown in FIG. 2A.

Figure 4A:
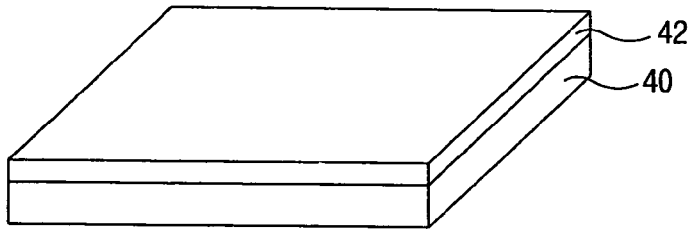
FIG. 4A is a mimetic diagram showing that a magnetic layer or a non-magnetic layer is cast on a carrier film.

Each process will be explained with reference to FIGS. 4A to 4E. FIG. 4A shows a step of preparing green sheets. A magnetic layer or a non-magnetic layer 42 are formed on a carrier film 40. In the present invention, the magnetic layer green sheet or the non-magnetic layer green sheet are respectively formed by using a doctor blade tape casting method used in a thick layer stacking process. As the carrier film, a PET film is used and another materials can be used. The carrier film is picked up when each layer is sequentially stacked after a fabrication of each layer is completed.

The green sheet that the magnetic layer or the non-magnetic layer are formed on the carrier film can be used as the cover layer by itself or by stacking several layers.

Figure 4B:
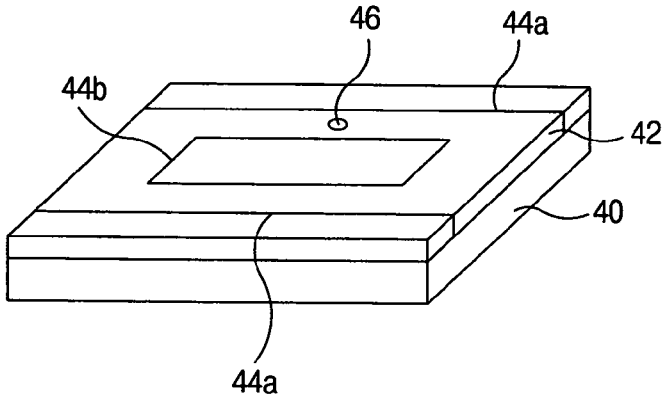
FIG. 4B is a mimetic diagram showing that a via hole and cutting lines are formed on a magnetic layer or a non-magnetic layer.

After forming the green sheet, as shown in FIG. 4B, cutting lines are formed constantly. The cutting lines are composed of an inner cutting line for a window 44*b* and both lateral cutting lines 44*a*. The cutting lines can be formed by a laser processing or a mechanical processing, in which the carrier film must not be damaged. A cutting processing of FIG. 4B is applied to both the magnetic layer green sheet and the non-magnetic layer green sheet.

The magnetic layer green sheet or the non-magnetic layer green sheet where the cutting lines are formed can be used as a buffer layer by itself or by stacking several layers. The non-magnetic layer green sheet where the inner cutting line for a window is not formed is used as a non-magnetic layer inserted to an inside of the magnetic substance which forms a magnetic core by itself or by stacking several layers.

As shown in FIG. 4B, on the non-magnetic layer 42 green sheet, a via hole 46 is formed besides the cutting lines 44*a* and 44*b*. The via hole is formed by using a laser punching or a mechanical punching.

Figure 4C:
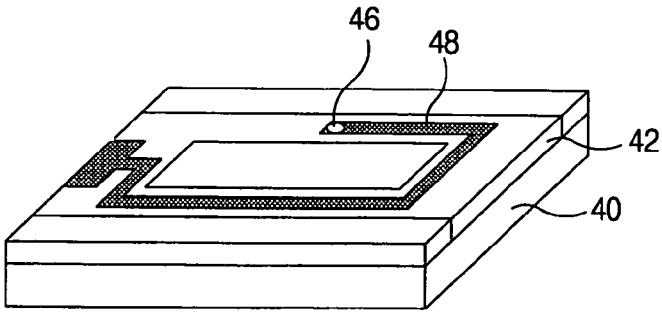
FIG. 4C is a mimetic diagram showing that an electrode pattern is formed on a non-magnetic layer.

As shown in FIG. 4C, on the non-magnetic 42 green sheet where the cutting lines and the via hole are formed, an electrode pattern 48 is formed. The electrode pattern can be formed as different patterns (for example, a pattern that an electrode pattern of a first sheet and an electrode pattern of a second sheet are symmetrical to each other) by an order of the non-magnetic electrode layer, and can be changed into various shapes according to a usage purpose of coil components. Also, one end of the electrode pattern extends up to an end of the green sheet thus to be electrically connected to an external electrode. A conductive paste is printed on an upper surface of the non-magnetic green sheet by using a screen printing method thus to form the electrode pattern, and a conductive material is filled in the via hole 46. Referring to FIG. 4C, one end of the electrode pattern 48 is connected to the via hole 46. This form is a means to electrically connect each electrode pattern on the non-magnetic electrode layer by each layer.

Figure 4D:
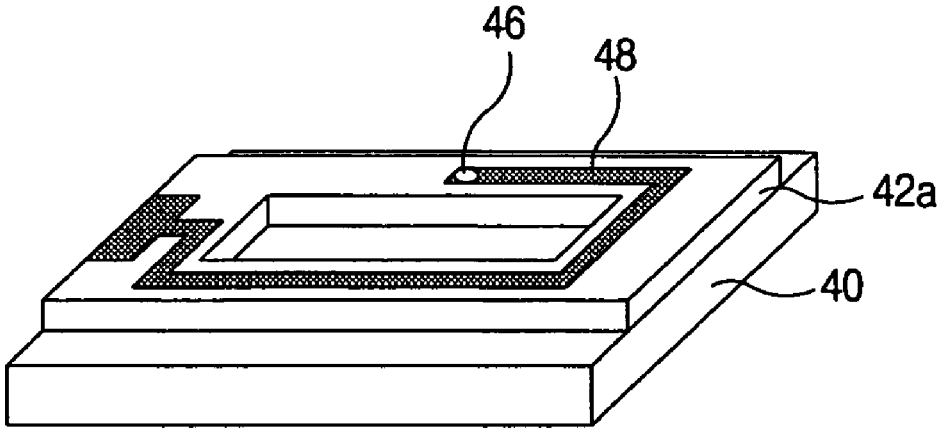
FIG. 4D is a mimetic diagram showing a non-magnetic layer of which unnecessary parts have been removed.
Figure 4E:
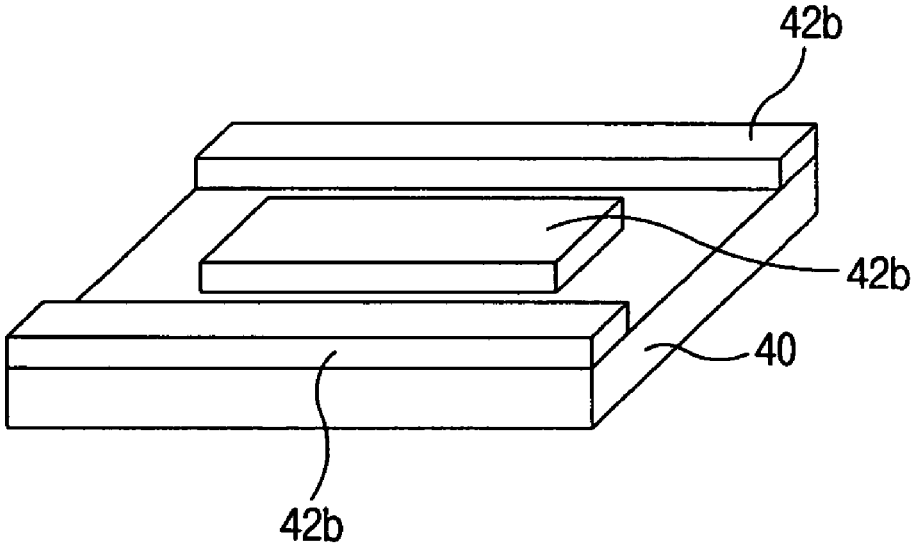
FIG. 4E is a mimetic diagram showing a magnetic layer of which unnecessary parts have been removed.

Unnecessary parts of the magnetic green sheet where the cutting lines are formed and the non-magnetic green sheet where the electrode patterns are formed are picked-up. At this time, picked-up regions of the magnetic green sheet and the non-magnetic green sheet are opposite to each other thus to constitute one single layer of the magnetic green sheet and the non-magnetic green sheet at the time of a stacking process which will be later explained. FIGS. 4D and 4E show the magnetic and non-magnetic green sheets where unnecessary parts are picked up. In FIG. 4D, a center region and a periphery region of the non-magnetic green sheet are picked up, and in FIG. 4E, a magnetic layer 42*b* of the magnetic green sheet remains only at a region opposite to that of the non-magnetic green sheet. The magnetic layer green sheet of which a center magnetic layer is picked up shown in FIG. 4E and the non-magnetic layer green sheet where the inner cutting line for a window is not formed are inserted to an inside of the magnetic substance which forms a magnetic core, thereby being used as a non-magnetic layer.

Figure 5A:
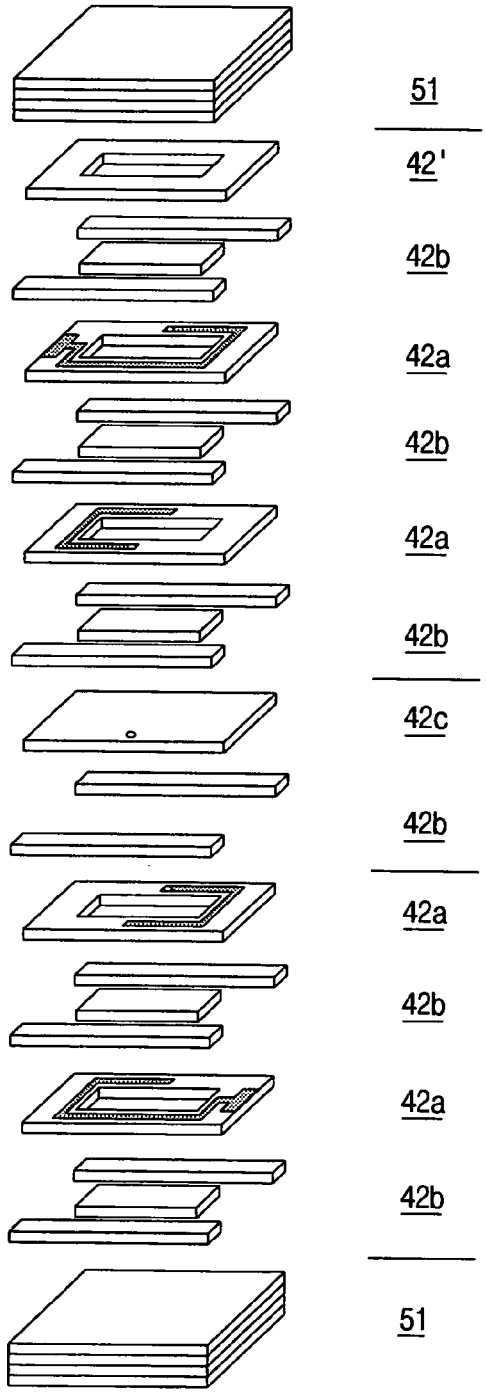
FIG. 5A is a flow chart showing a stack of a chip type power inductor according to the present invention.

Once a fabrication of each layer is finished, each layer is sequentially stacked. FIG. 5A shows a stack processing, in which each layer is sequentially stacked as one.

Figure 5B:
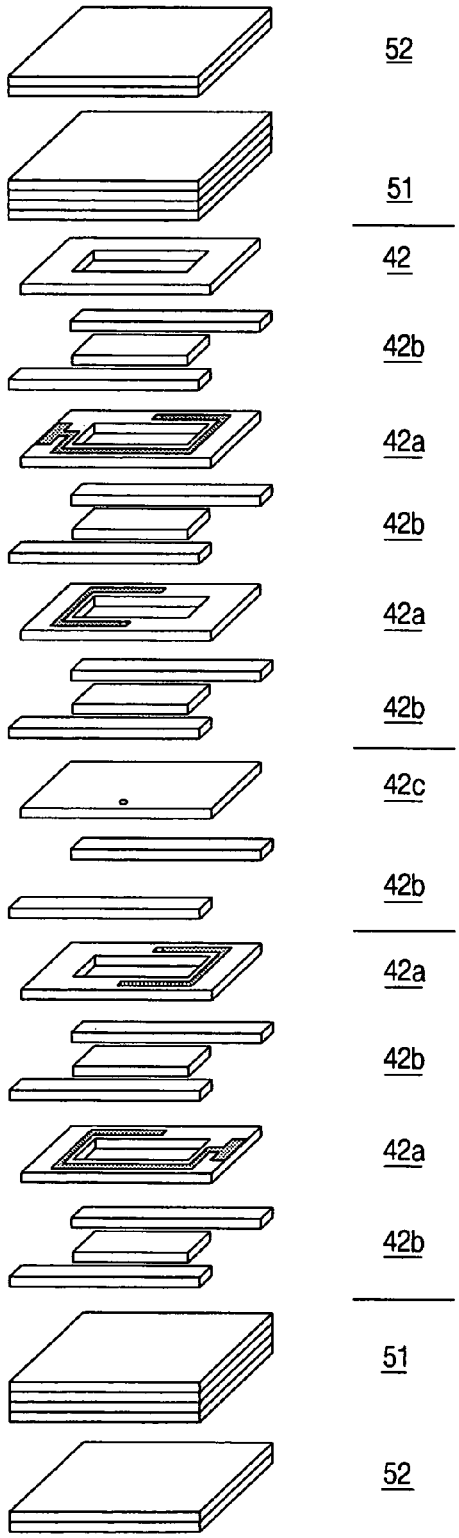
FIG. 5B is a flow chart showing another stack of a chip type power inductor according to the present invention.

Referring to FIG. 5A, a plurality of electrode layers that the magnetic layer 42*b* and the non-magnetic layer 42*a* constitute one layer between the cover layers 51 positioned at both ends are stacked. The cover layer is composed of a magnetic layer, but can be composed of a magnetic layer and a non-magnetic layer as another embodiment (Refer to FIG. 5B, 51 denotes a magnetic cover layer and 52 denotes a non-magnetic cover layer). The additional non-magnetic cover layer attenuates a minute thermal expansion rate difference between the magnetic layer and the non-magnetic layer generated at the time of a firing process thus to stabilizes a mechanical structure of a product.

A non-magnetic layer 42' where the electrode pattern is not formed can be used as a buffer layer in order to prevent electrode patterns formed on the non-magnetic layer from being in directly contact with the upper cover layer. The green sheet fabricated in FIGS. 4A and 4B and the green sheet where the cutting lines are formed are used as the cover layer and the buffer layer in a state that the carrier film is respectively picked-up.

The non-magnetic layer 42*a* and the magnetic layer 42*b* fabricated in FIGS. 4D and 4E are alternately stacked thus to form an electrode layer. Even though the electrode layer is composed of four layers in drawings, more layers are preferably stacked. The non-magnetic layer 42*a* and the magnetic layer 42*b* are alternately stacked and thus exist in the same layer. By this stack, the electrode patterns formed on the non-magnetic layer are electrically connected to each other. Herein, one end of the electrode pattern (48 of FIG. 4C) is connected to a via hole (46 of FIG. 4C) thus to be electrically connected to another end of the electrode pattern of another layer.

A non-magnetic layer 42*c* where the electrode pattern is not formed is inserted between the stacked electrode layers thus to form a micro gap which shields a magnetic path inside of the stacked body. The non-magnetic layer 42*c* constitutes one layer with a magnetic layer 42*b*'. Although the inner magnetic flux shielding layer is composed of one non-magnetic layer in drawings, several non-magnetic layers can be inserted according to electric characteristics of a final product.

Figure 6A:
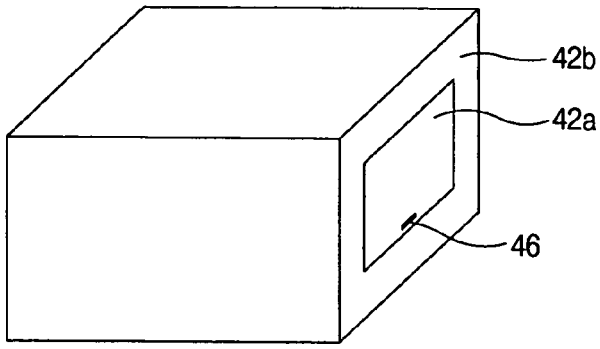
FIG. 6A is a mimetic diagram showing a chip type power inductor fabricated by the process of FIG. 5A.
Figure 6B:
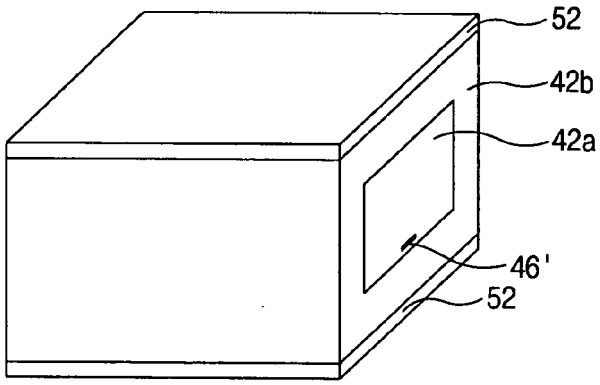
FIG. 6B is a mimetic diagram showing a chip type power inductor fabricated by the process of FIG. 5B.
Figure 6C:
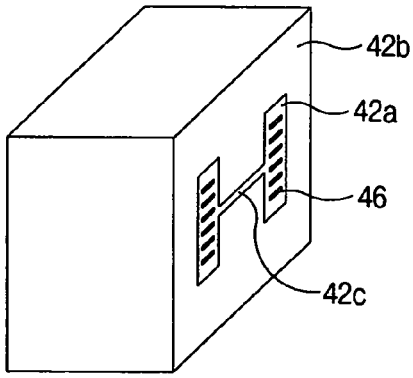
FIG. 6C is a perspective view showing an inside of a fabricated chip type power inductor.
Figure 6D:
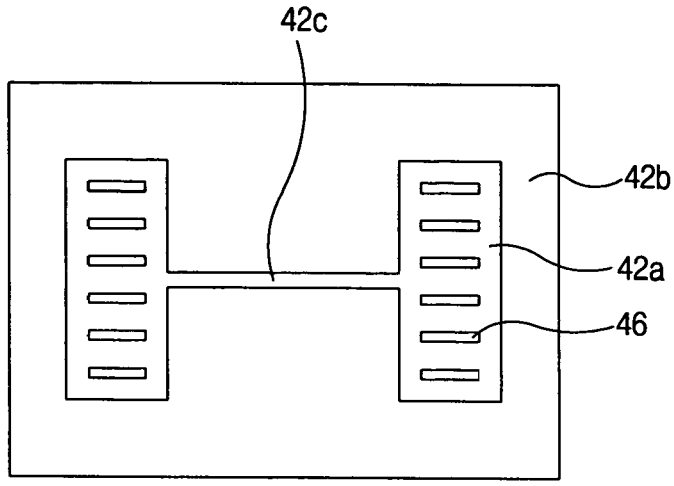
FIG. 6D is a sectional view showing an inside of a fabricated chip type power inductor.

At least two ends of the electrode patterns formed on the non-magnetic layer extend up to an edge of the non-magnetic layer for an external electrical contact, and external electrodes are formed at the extended end after stacking. FIG. 6A shows a state that the stacking has been finished, in which an outwardly extended end 46' of the electrode pattern can be seen. FIG. 6B shows that the non-magnetic cover layer 52 is additionally formed by the process of FIG. 5B. FIGS. 6C and 6D are perspective and sectional views showing inside of the fabricated power inductor.

When the inner electrode pattern, the non-magnetic substance, and the magnetic substance are simultaneously fired by firing the stack body after stacking, an electrode pattern of a coil form, an insulating region of a non-magnetic substance, and a magnetic path of a magnetic substance are formed.

Figure 6E:
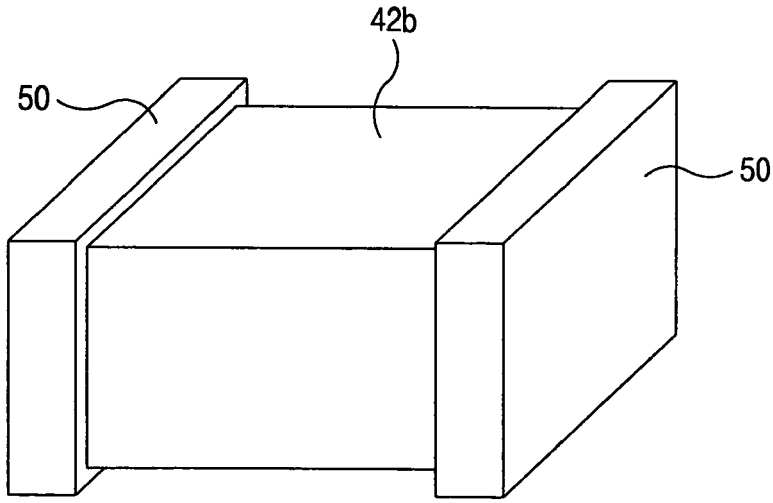
FIG. 6E is a chip type power inductor where an external electrode is formed.

After the firing process, external electrodes are formed at lateral surfaces of the stack body by using a dipping or a roller. FIG. 6E shows a final product where the external electrodes have been formed.

By said fabrication process, the chip type power inductor of the present invention can be economically fabricated and a large amount of devices can be fabricated fast.

As aforementioned, in the present invention, a magnetic flux inside of the power inductor can be controlled, so that a DC bias characteristic corresponding to several hundreds of mA~1A which could not be realized by the conventional multi-layer chip power inductor can be obtained. Also, a multi-layer power inductor of a very small size can be fabricated thus to be used in a notebook PC, another small communication devices, and electric instruments. Besides, according to the fabrication method of the present invention, a productivity is excellent thus to economically fabricate a large amount of products.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A fabrication method of a chip type power inductor comprising:

preparing green sheets with a magnetic layer and a non-magnetic layer respectively formed on a carrier film;

forming cutting lines on the magnetic layer green sheet and the non-magnetic layer green sheet;

forming via holes on the non-magnetic layer green sheet where the cutting lines are formed, and forming an electrode pattern at an upper surface of the non-magnetic layer green sheet;

picking up unnecessary parts from the magnetic layer green sheet and the non-magnetic layer green sheet and thus corresponding remaining parts of the magnetic substance to the picked up parts of the non-magnetic substance or corresponding the picked up parts of the magnetic substance to remaining parts of the non-magnetic substance;

stacking a plurality of layers by constituting the magnetic layer and the non-magnetic layer where via holes and electrode patterns are formed as one unit in a state that a non-magnetic layer where cutting lines and electrode patterns are not formed is inserted;

stacking a cover layer composed of a magnetic layer at upper and lower surfaces of the stacked layers;

firing the stacked body; and forming external electrodes at an outer surface of the fired stack body.

2. The method of claim 1, wherein the magnetic layer or the non-magnetic layer on the carrier film are respectively formed by using a doctor blade tape casting method.

3. The method of claim 1, wherein the electrode pattern of an upper surface of the non-magnetic layer green sheet is formed by a screen printing.

* * * * *